US005720414A

United States Patent [19]

Adams

[11] Patent Number: 5,720,414

[45] Date of Patent: Feb. 24, 1998

[54] WATER INFUSION SYSTEM

[76] Inventor: Rodney W. Adams, 38174 N. Harper Rd., Beach Park, Ill. 60087

[21] Appl. No.: 543,049

[22] Filed: Oct. 13, 1995

[51] Int. Cl.[6] ..... B67B 7/00

[52] U.S. Cl. ..... 222/1; 222/641; 222/105; 222/129.1; 141/100; 141/114; 141/231

[58] Field of Search ..... 222/1, 640, 641, 222/129, 129.1–129.4, 105, 396, 397, 504; 141/114, 10, 313, 314, 100, 317, 231; 206/219

[56] References Cited

U.S. PATENT DOCUMENTS 4,386,634 6/1983 Stasz et al. ..... 141/114 X
4,785,974 11/1988 Rudick et al. ..... 222/105
4,901,886 2/1990 Kirschner ..... 222/129.1 X
5,027,980 7/1991 Bell ..... 206/219 X
5,293,909 3/1994 Weiss ..... 141/100 X

*Primary Examiner*—Gregory L. Huson
*Attorney, Agent, or Firm*—Jack Shore

[57] ABSTRACT

A system for providing a precise amount of dilution liquid to a container of concentrate to produce a reconstituted concentrate of the desired consistency. This is accomplished by introducing the liquid at a predetermined pressure controlled by a pressure regulator for a preset period set by a timed valve mechanism.

4 Claims, 1 Drawing Sheet

WATER INFUSION SYSTEM

FIELD OF THE INVENTION

This application relates to a system for providing the prescribed amount of water into a sauce concentrate or a dry mix to provide the requisite consistency of the end product desired.

BACKGROUND OF THE INVENTION

Heretofore, it has been common practice to provide restaurants that serve pizzas with large cans of concentrate that are opened in the kitchen and mixed with a liquid such as water to provide the proper consistency for the topping. Concentrate is generally provided in large No. 10 cans that have to be diluted or in the well known bag-in-box containers that are filled with the requisite reconstituted concentrate. In the case of using product from open cans, it can be appreciated that such manual operations by typical kitchen help present a number of problems when taking the concentrate out of the can and putting it into another receptacle wherein it is mixed with water to provide the desired concentration. Since this procedure is very imprecise, there is always the concern that the product does not end up with the proper uniform consistency. What often happens is that too much or too little water is added, with the result that too much concentrate is used or the concentrate is too diluted.

An additional concern is that when one deals with an open can, there is a problem of possible contamination and other sanitation problems that may arise. Unfortunately, drippage often occurs and flying insects or other contaminants may be present that raise other sanitation problems. Clearly, the exposure to air for any period of time can result in possible contamination that should be avoided at all costs. This manual type of system requires that the end product be formulated by hand, and the user would be diluting the concentrate with an imprecise amount of water that would result in an inconsistent end product. Also, if the product was purchased in a reconstituted form, there would be higher shipping costs and more storage space required.

SUMMARY OF THE INVENTION

The present invention overcomes the inherent problems referred to above. Applicant's novel method and apparatus consists of incorporating a sealed container filed with concentrate and providing a dilution medium such as water from a source of potable water that is immediately available at the normal inhouse water pressure that is to be introduced into the sealed container. To insure that there is the proper consistency of the reconstituted concentrate, the conduit means between the water source and the sealed container includes a pressure regulator that sets the pressure of the water leaving the pressure regulator. The prescribed amount of water that is to flow into the sealed container is determined by a timing device such as a solenoid-operated timer that opens a valve for a predefined time that results in the prescribed amount of water being introduced into the concentrate. This insures that there is a consistency of product. The connection between the water source and the sealed container is totally enclosed, which ensures that during the reconstituting of the concentrate there is no exposure to atmosphere. Thus, there is no possibility of contamination. After the water is introduced into the concentrate and the water source removed, the sealed, flexible container is kneaded to obtain the desired uniformity of the product therein.

BRIEF DESCRIPTION OF THE DRAWINGS

The FIGURE is a schematic illustration of the system embodying the present invention.

DESCRIPTION OF A PREFERRED EMBODIMENT

Figure 1:
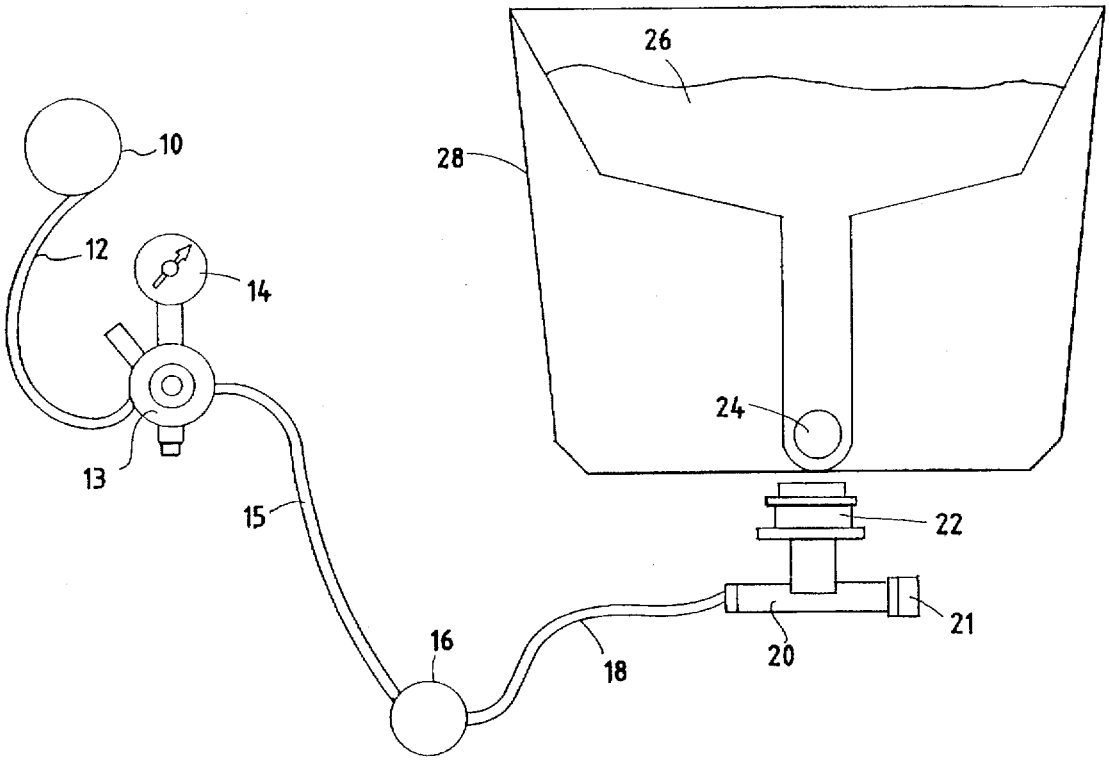

Referring to the FIGURE, there is shown applicant's novel system consisting of a source of potable water 10, which water is normally under inhouse water pressure which would vary from 30 to 80 pounds per square inch. The water from the source 10 flows through the conduit 12 and is regulated by a water pressure regulator 13 having a gauge 14. The water pressure in conduit 15 is normally set at approximately 20 pounds per square inch. The flow between conduit 15 and conduit 18 is controlled by a solenoid-operated timer valve 16 that is opened a prescribed amount of time to allow a predetermined amount of water flowing between conduits 15 and 18. The water in conduit 18 flows through a fitting 20 and a quick-connect/disconnect connector 22 into the flexible bag 26 containing the concentrate. The conduit 18 is closed off at one end by end cap 21.

In the embodiment shown, the bag 26 containing the concentrate is located in a saddle 28 that is hung on a wall or some other suitable support during the filling process but this is by way of example only. When filled, the bag could be placed in a refrigerator for future use. The interior of the bag is closed off by a cap 24 threaded onto a bag spout. The cap prevents dirt or dust from coming into contact with an internal slider disposed in the spout. The slider mechanism (not shown) that prevents the outward flow of concentrate from the bag 26 until the slider mechanism is moved onto the interior of the bag. The device whereby the flow of water introduced into the bag 26 through the conduit 18 and fitting 20 is controlled is the quick-connect/disconnect connector 22 which is secured to the spout after the cap is removed. The connector 22 is a conventional fitting known in the trade as a QC/D connector that includes a locking plate at the base for positive gripping of the bag spout and a tapered probe assembly that fits into the bag opening after the cap 24 is removed. The probe assembly includes a probe that when disposed in the spout it pushes the slider into the bag. A pin on the slider unseats a valve mechanism in the probe and opens a channel to permit water to flow into the bag. When the connector is withdrawn, the bag is sealed to retain the water and concentrate solution in the bag 26. The bag is a flexible bag and thus can be kneaded by an operator for approximately one minute to provide for a consistent mixture. It can be appreciated that at no time does the mixture come into contact with the atmosphere and therefore there is no possibility of contamination. Also, as aforementioned, the timer is set for a predetermined length of time so that a prescribed amount of water is directed into the bag to reconstitute the concentrate located in the bag. It can be appreciated that the bag will contain the correct amount of water and there will be a totally accurate consistency of the reconstituted product.

It can be appreciated that such embodiments as will occur to one skilled in the art are encompassed within the following claims.

What is claimed is:

1. The method of introducing a predetermined amount of dilution liquid into a container filled with a concentrate consisting of the steps of providing a source of liquid under pressure, directing the liquid under pressure from said source to said container, regulating the pressure of said liquid and timing the flow of said pressure-regulated liquid to said container to precisely determine the amount of dilution liquid provided to said concentrate to reconstitute said concentrate to the desired consistency.

2. The method as set forth in claim 1 including the step of unsealing the container of concentrate for the introduction of diluting liquid without exposing the concentrate to the atmosphere.

3. A system for providing a container of reconstituted concentrate including a sealed container containing concentrate, conduit means for interconnecting a source of water under pressure with said container, a water pressure regulator for setting the pressure of the water flowing through the conduit means to the concentrate container, and a control mechanism consisting of a solenoid-operated timer in said conduit means between said pressure regulator and concentrate container for determining the amount of water introduced into said concentrate container to provide a reconstituted concentrate having the desired consistency.

4. A system for providing a container of reconstituted concentrate including a sealed container containing concentrate consisting of a flexible bag disposed in a wall-mounted saddle, conduit means for interconnecting a source of water under pressure with said container, a water pressure regulator for setting the pressure of the water flowing through the conduit means to the concentrate container, and a control mechanism in said conduit means between said pressure regulator and concentrate container for determining the amount of water introduced into said concentrate container to provide a reconstituted concentrate having the desired consistency, whereby the container may be kneaded to provide a generally uniform reconstituted concentrate and the concentrate may be quickly and efficiently utilized.

* * * * *